US008465304B2

(12) United States Patent
Yen

(10) Patent No.: US 8,465,304 B2
(45) Date of Patent: Jun. 18, 2013

(54) CONNECTOR MECHANISM CAPABLE OF ADJUSTING A HEIGHT OF AN OPENING THEREOF

(75) Inventor: Chia-Lian Yen, New Taipei (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 84 days.

(21) Appl. No.: 13/198,695

(22) Filed: Aug. 4, 2011

(65) Prior Publication Data

US 2012/0052704 A1 Mar. 1, 2012

(30) Foreign Application Priority Data

Aug. 24, 2010 (TW) ..... 99128258 A

(51) Int. Cl.
*H01R 13/44* (2006.01)

(52) U.S. Cl.
USPC ..... 439/131; 439/676

(58) Field of Classification Search
USPC ..... 439/131, 676, 946
See application file for complete search history.

(56) References Cited

U.S. PATENT DOCUMENTS 5,679,013 A 10/1997 Matsunaga
6,905,351 B1 * 6/2005 Wang et al. ..... 439/131
6,979,209 B2 * 12/2005 Griepentrog ..... 439/131
7,001,192 B1 * 2/2006 Yeh ..... 439/131
7,841,876 B2 * 11/2010 Lin et al. ..... 439/144

FOREIGN PATENT DOCUMENTS

CN 1123477 A 5/1996

OTHER PUBLICATIONS

Office action mailed on Mar. 5, 2013 for the China application No. 201010268665.2, p. 3 line 3-31 and p. 4. Translation.

* cited by examiner

*Primary Examiner* — Hien Vu
(74) *Attorney, Agent, or Firm* — Winston Hsu; Scott Margo

(57) ABSTRACT

A connector mechanism includes a base and a casing. An opening is formed on a side of the base and the casing. The connector mechanism further includes a circuit terminal installed on the base, and a sliding socket connected to the base in a slidable manner and disposed on a side of the circuit terminal. The connector mechanism further includes a contacting terminal installed on the sliding socket for contacting with the circuit terminal. The connector mechanism further includes a sliding cover pivoted to the sliding socket, and at least one resilient component. The resilient component drives the sliding cover to separate from the sliding socket when the sliding socket slides to a position relative to the base where the casing does not constrain the sliding cover so as to generate a distance between the sliding cover and the sliding socket greater than a height of the opening.

10 Claims, 8 Drawing Sheets

CONNECTOR MECHANISM CAPABLE OF ADJUSTING A HEIGHT OF AN OPENING THEREOF

BACKGROUND OF THE INVENTION

1. Field of the Invention

The present invention relates to a connector mechanism, and more particularly, to a connector mechanism capable of adjusting a height of an opening thereof.

2. Description of the Prior Art

With the development of information and computer technology, the size of a computer is becoming smaller and the computer is utilized in a wide variety of fields. In order to expand functions of a computer system for satisfying user's various demands, various external devices of the computer system come with the trend. For example, an external hard disk drive and a portable storage device can expand the memory capacity of the computer system. An external optical disk drive and an optical disk writer can expand multimedia access function of the computer system. A network cable allows the computer system to be connected to an internet so as to gather information online or surf webpage. However, because of the thinning size of the notebook computer, it brings more challenges for mechanical design. Connecting ports disposed on a side of the notebook computer will constrain the thickness of mechanism of the notebook computer. For example, an Ethernet port (such as a RJ 45 port) for connecting to network or RJ11 port for connecting a telephone cable has a fixed size of the opening. So, the notebook computer needs to increase its thickness in order to match the size of the connecting ports. Alternatively, the network port or the telephone port is exposed out of the notebook computer so as to affect an aesthetic feeling of appearance. Thus, the conventional connector mechanism has importance issues of satisfying the height specification as well as keeping the aesthetic feeling of appearance.

SUMMARY OF THE INVENTION

The present invention provides a connector mechanism capable of adjusting a height of an opening thereof for solving above drawbacks.

According to the claimed invention, a connector mechanism capable of adjusting a height of an opening thereof includes a base and a casing for covering the base. An opening is formed on a side of the base and the casing. The connector mechanism further includes a circuit terminal installed on the base and a sliding socket connected to the base in a slidable manner and disposed on a side of the circuit terminal. At least one hole is formed on the sliding socket. The connector mechanism further includes a contacting terminal installed on the sliding socket and a sliding cover pivoted to the sliding socket. The contacting terminal passes through the hole for contacting with the circuit terminal. The connector mechanism further includes at least one resilient component. One end of the resilient component is connected to the sliding socket, the other end of the resilient component is connected to the sliding cover, and the resilient component drives the sliding cover to separate from the sliding socket when the sliding socket slides to a position relative to the base where the casing does not constrain the sliding cover so as to generate a distance between the sliding cover and the sliding socket greater than a height of the opening.

According to the claimed invention, sliding slots are respectively formed on a side of the base and on a side of the casing, a protruding part is formed on a side of the sliding socket, and the sliding socket is installed in the sliding slots in a slidable manner.

According to the claimed invention, at least one slot is formed on a bottom side of the base, and the slot contains an end of the circuit terminal when the contacting terminal presses down the end of the circuit terminal.

According to the claimed invention, the end of the circuit terminal is a bending structure and abuts against the contacting terminal.

According to the claimed invention, the sliding socket comprises a fixing part for fixing the contacting terminal.

According to the claimed invention, the resilient component is a clip.

According to the claimed invention, the resilient component drives the sliding cover and the sliding socket to form an angle of approximately 24 degrees therebetween when the sliding socket slides to the position relative to the base where the casing does not constrain the sliding cover.

According to the claimed invention, the circuit terminal is a normal-type circuit terminal.

According to the claimed invention, the circuit terminal is a reverse-type circuit terminal.

According to the claimed invention, the contacting terminal is an Ethernet contacting terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
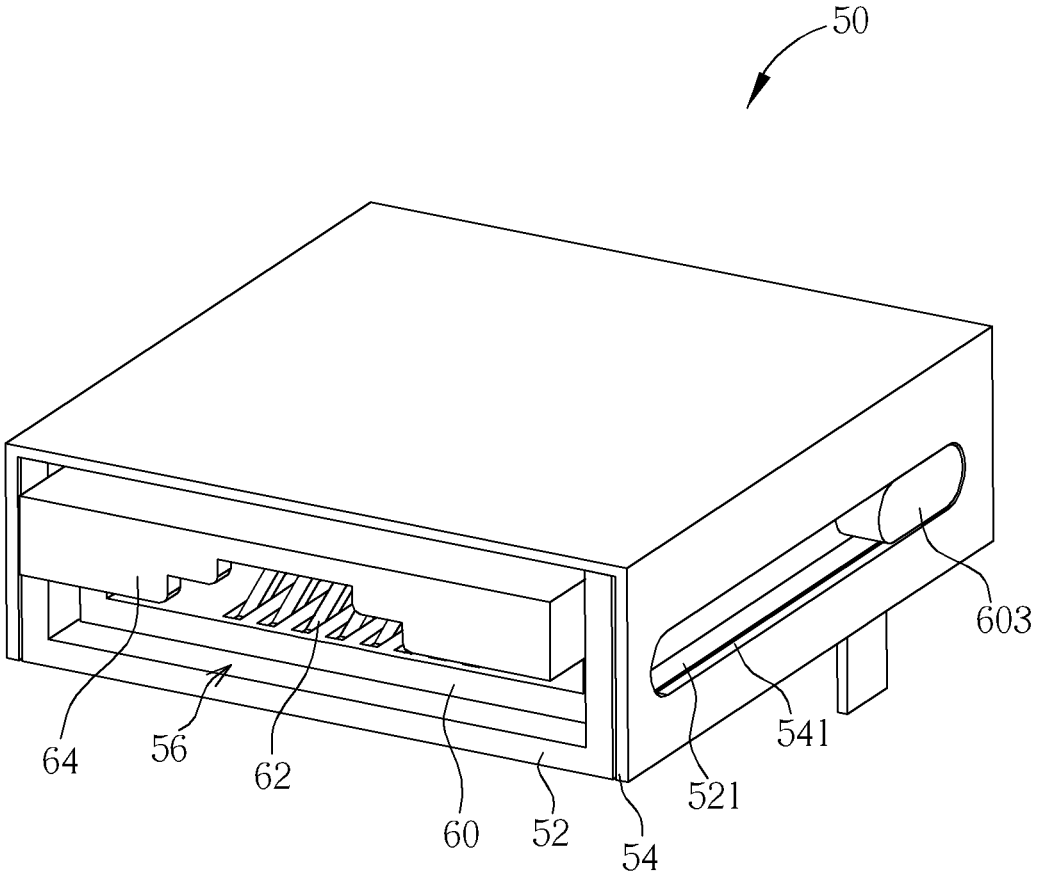
FIG. 1 and FIG. 2 are diagrams of a connector mechanism in different statuses respectively according to a preferred embodiment of the present invention.
Figure 2:
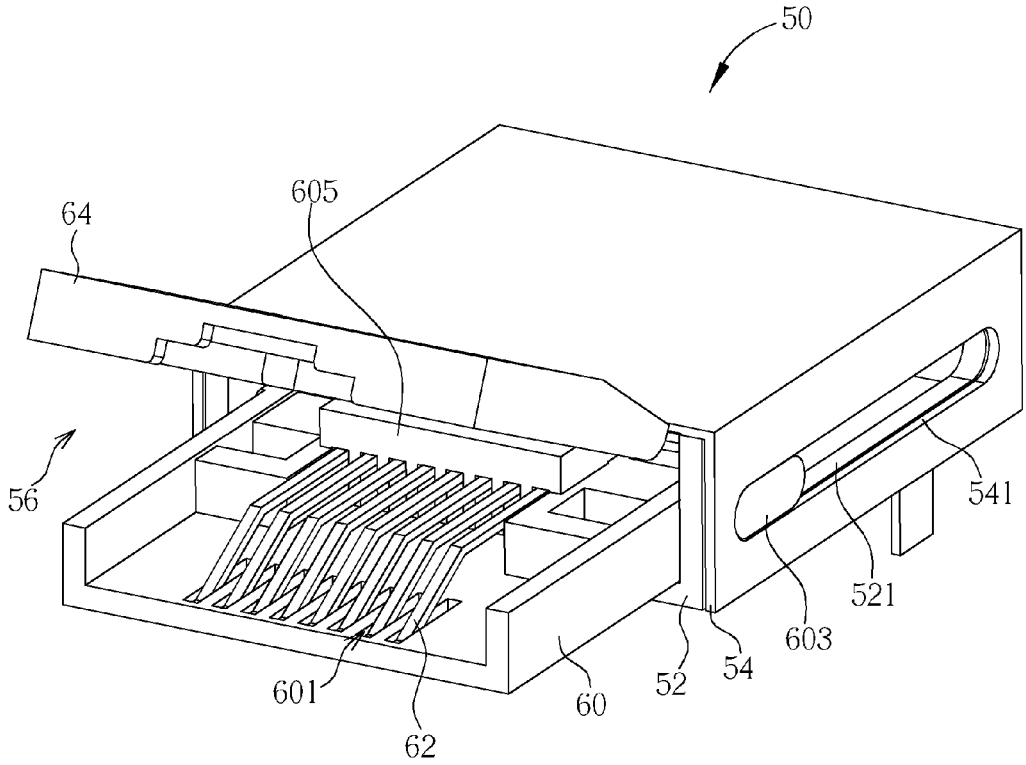
Figure 3:
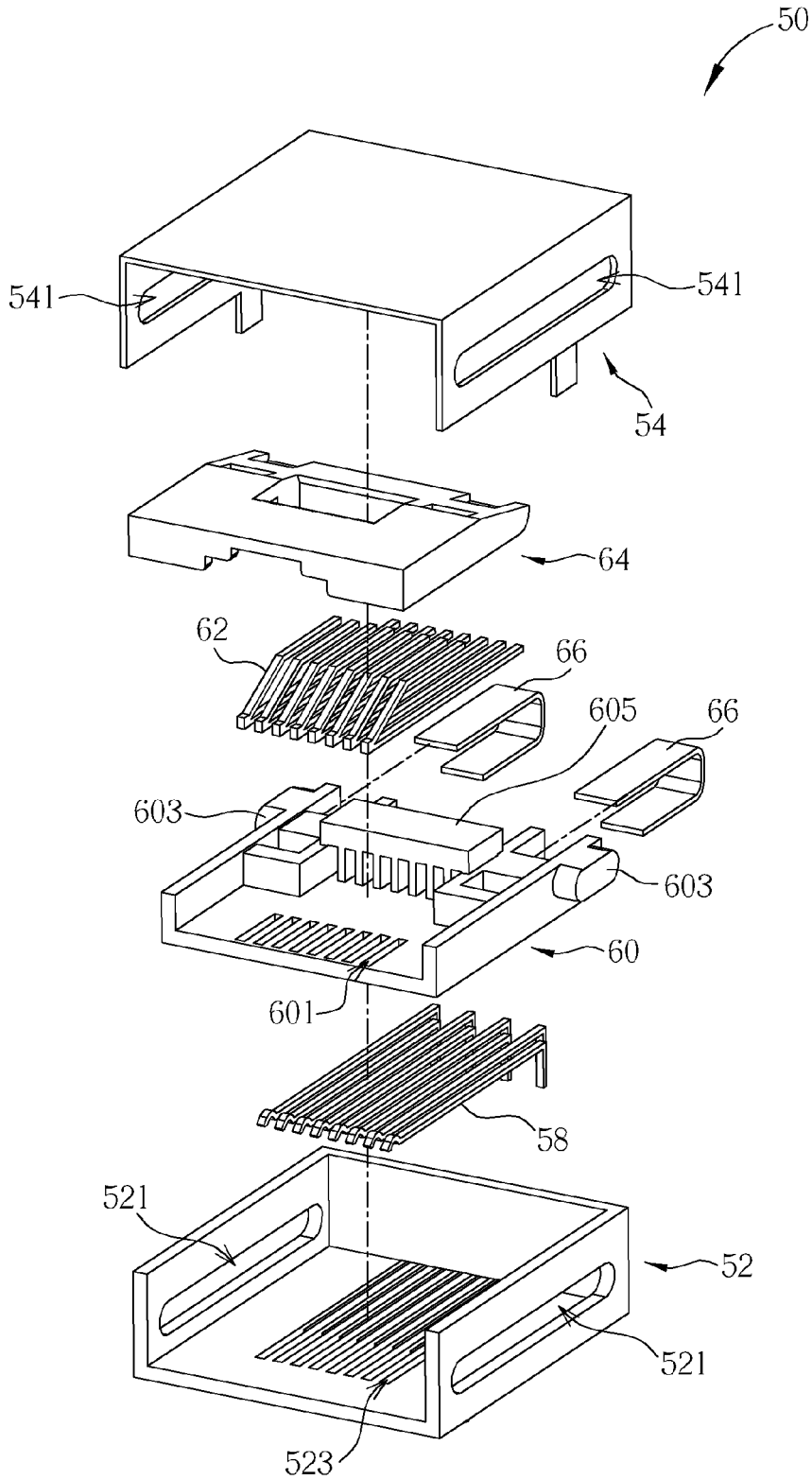
FIG. 3 is an exploded diagram of the connector mechanism according to the preferred embodiment of the present invention.

Please refer to FIG. 1 to FIG. 3. FIG. 1 and FIG. 2 are diagrams of a connector mechanism 50 in different statuses respectively according to a preferred embodiment of the present invention. FIG. 3 is an exploded diagram of the connector mechanism 50 according to the preferred embodiment of the present invention. The connector mechanism 50 includes a base 52. Two sliding slots 521 are respectively formed on both sides of the base 52, and a slot 523 is formed on a bottom side of the base 52. The connector mechanism 50 further includes a casing 54 for covering the base 52. Two sliding slots 541 are respectively formed on both sides of the casing 54. When the casing 54 covers the base 52, the sliding slots 521 of the base 52 are aligned with the sliding slots 541 of the casing 54. The sliding slots 541 can be omitted. An opening 56 is formed on a side of the base 52 cooperatively with a side of the casing 54. In addition, the casing 54 can be made of metal. The connector mechanism 50 further includes a circuit terminal 58 installed on the base 52. The circuit terminal 58 is electrically connected to a circuit board of an electronic device. In this embodiment, the circuit terminal 58 can be a reverse-type circuit terminal, that is, the connector mechanism 50 can be a reverse-type connector mechanism. The connector mechanism 50 further includes a sliding socket 60 connected to the base 52 in a slidable manner and disposed on a side of the circuit terminal 58, and at least one hole 601 is formed on the sliding socket 60. Two protruding components 603 respectively formed on both sides of the sliding socket 60 are installed in the sliding slots 521 of the base 52 and in the sliding slots 541 of the casing 54 respectively. In such a manner, the sliding socket 60 is capable of sliding relative to the base 52 and the casing 54.

The connector mechanism 50 further includes a contacting terminal 62 installed on the sliding socket 60. The contacting terminal 62 passes through the hole 601 of the sliding socket 60 for continuously contacting with an end of the circuit terminal 58 so as to be continuously electrically connected to the circuit board of the electronic device. The end of the circuit terminal 58 can be a bending structure for continuously contacting with the contacting terminal 62. The slot 523 formed on the bottom side of the base 52 contains the end of the circuit terminal 58 when the contacting terminal 62 presses down the end of the circuit terminal 58 so as to provide the end of the circuit terminal 58 with a buffering space for elastic deformation of the end of the circuit terminal 58. The contacting terminal 62 can be an Ethernet contacting terminal (such as a RJ45 contacting terminal), a cable modem contacting terminal (such as a RJ 11 contacting terminal) and so on. In other words, the connector mechanism 50 can be an Ethernet connector mechanism, a cable modem connector mechanism and so on. In addition, the sliding socket 60 includes a fixing part 605 for fixing the contacting terminal 62. For example, an end of the contacting terminal 62 can be engaged in the fixing part 605 so as to constrain a height of the contacting terminal 62. The connector mechanism 50 further includes a sliding cover 64 pivoted to the sliding socket 60. The connector mechanism 50 further includes at least one resilient component 66. In this embodiment, the connector mechanism 50 includes two resilient components 66 disposed on two sides of the sliding socket 60 and on two sides of the sliding cover 64 respectively. An end of each of the resilient components 66 is connected to the sliding socket 60 and the other end is connected to the sliding cover 64. The resilient components 66 can be clips for driving the sliding cover 64 to rotate relative to the sliding socket 60.

Figure 4:
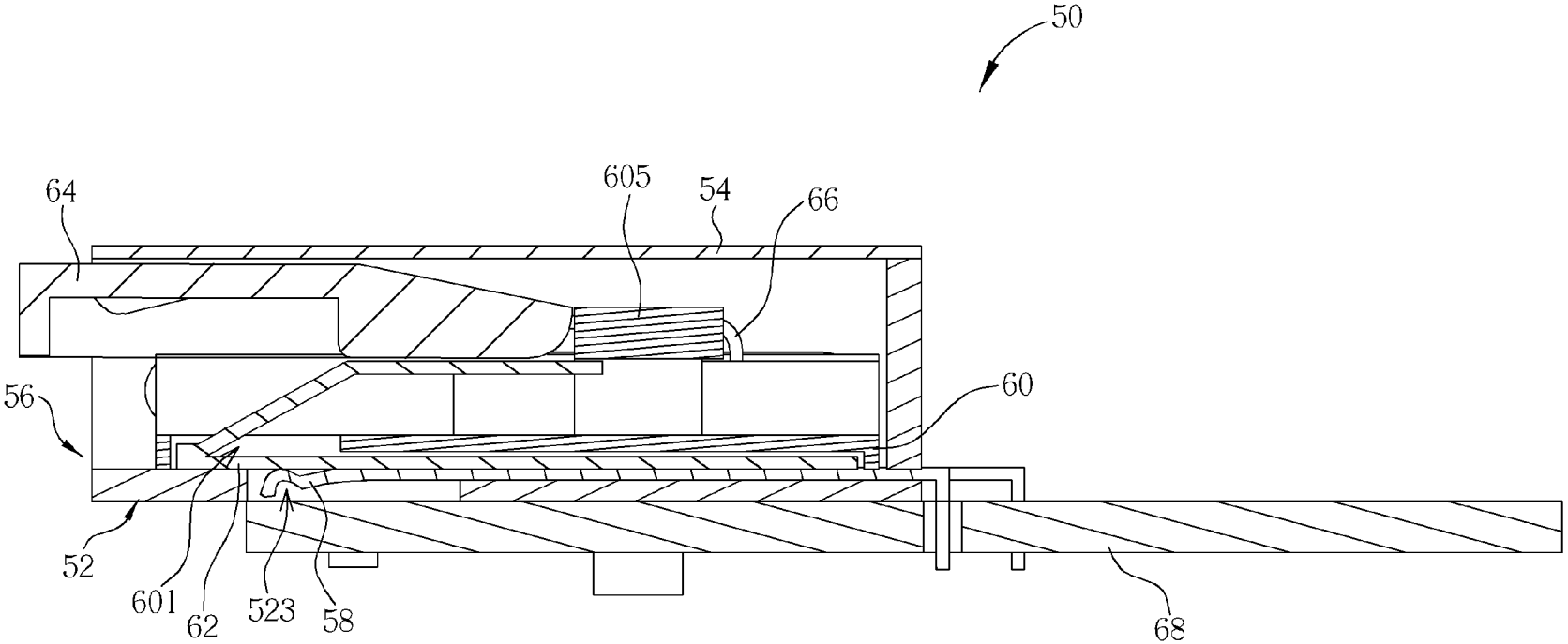
FIG. 4 and FIG. 5 are sectional views of the connector mechanism in different statuses respectively according to the preferred embodiment of the present invention.
Figure 5:
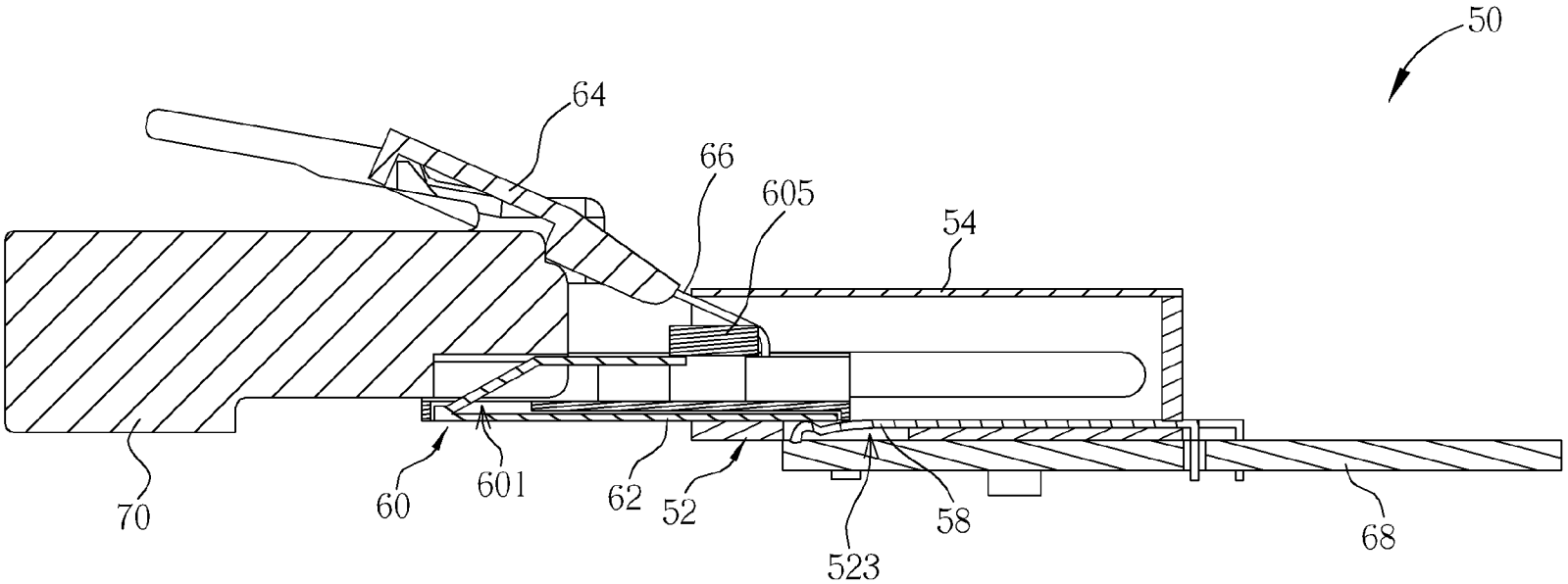

Please refer to FIG. 1 to FIG. 5. FIG. 4 and FIG. 5 are sectional views of the connector mechanism 50 indifferent statuses respectively according to the preferred embodiment of the present invention. The base 52 is fixed on a circuit board 68 and is capable of being installed on a side of the electronic device. As shown in FIG. 1 to FIG. 4, the sliding socket 60 and the sliding cover 64 are contained in an internal accommodating space of the base 52 and the casing 54 when the connector mechanism 50 is in an initial status and is not connected to an external terminal. At this time, the casing 54 constrains rotation of the sliding cover 64. If the connector mechanism 50 is used for being connected to the external terminal, the sliding cover 64 is drawn outward so as to pull the sliding socket 60 to slide relative to the base 52. As shown in FIG. 2 and FIG. 5, the resilient components 66 in a compressed status can elastically recover to an initial status when the sliding socket 60 slides to a position relative to the base 52 where the casing 54 does not constrain the sliding cover 64, so as to drive the sliding cover 64 to be away from the sliding socket 60. Accordingly, a distance between the sliding cover 64 and the sliding socket 60 is greater than a height of the opening 56 shown in FIG. 1 and FIG. 4. At this time, a maximum angle of approximately 24 degrees is formed between the sliding cover 64 and the sliding socket 60, resulting in that a terminal 70 with size larger than the height of the opening 56 can be inserted into the sliding socket 60 and the sliding cover 64 smoothly and contacts with the contacting terminal 62 so that the terminal 70 is electrically connected to the circuit board 58.

When the sliding socket 60 and the sliding cover 64 are contained inside the base 52 and the casing 54 as shown in FIG. 1 and FIG. 4, the height of the opening 56 in such a condition can not allow the terminal 70 to be inserted into the sliding socket 60 and the sliding cover 64. Only when the sliding socket 60 and the sliding cover 64 are pulled out of the base 52 and the casing 54 as shown in FIG. 2 and FIG. 5, the resilient components 66 drive the sliding cover 64 to rotate upwards so as to increase the distance between the sliding cover 64 and the sliding socket 60. In such a manner, the terminal 70 can be inserted into the sliding socket 60 and the sliding cover 64 successfully. After using, the terminal 70 can be pulled out, and then the sliding cover 64 is pressed down and pushes the sliding cover 64 from a position shown in FIG. 1 and FIG. 4 to a position shown in FIG. 2 and FIG. 5 so that the sliding socket 60 and the sliding cover 64 are again contained inside the base 52 and the casing 54. The distance that the sliding socket 60 slides relative to the base 52 and the casing 54 is controlled by a length of the sliding slot 521 of the base 52 and the sliding slot 541 of the casing 54. In other words, when the protruding component 603 of the sliding socket 60 slides to an end of the sliding slot 521 of the base 52 and to an end of the sliding slot 541 of the casing 54, the sliding socket 60 and the sliding cover 64 are completely contained inside the base 52 and the casing 54, or alternatively the sliding socket 60 and the sliding cover 64 are completely pulled out of the base 52 and the casing 54 so that the sliding socket 60 and the sliding cover 64 forms a maximum angle therebetween. Furthermore, the connector mechanism 50 of the present invention allows a user using one hand to operate, that is, the sliding socket 60 and the sliding cover 64 can be pulled or pushed by one hand so as to provide convenience in use.

Figure 6:
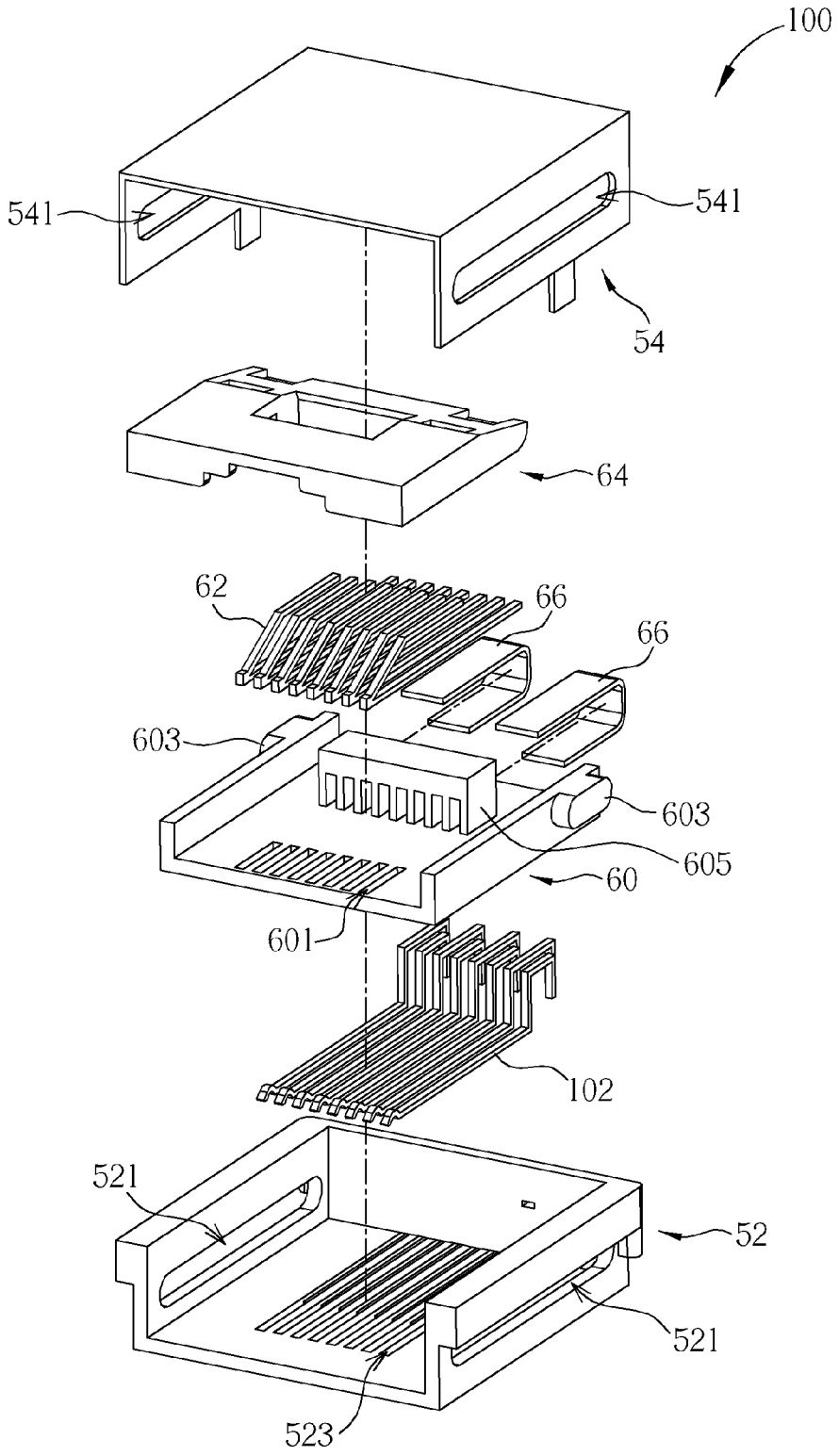
FIG. 6 is an exploded diagram of a connector mechanism according to another preferred embodiment of the present invention.
Figure 7:
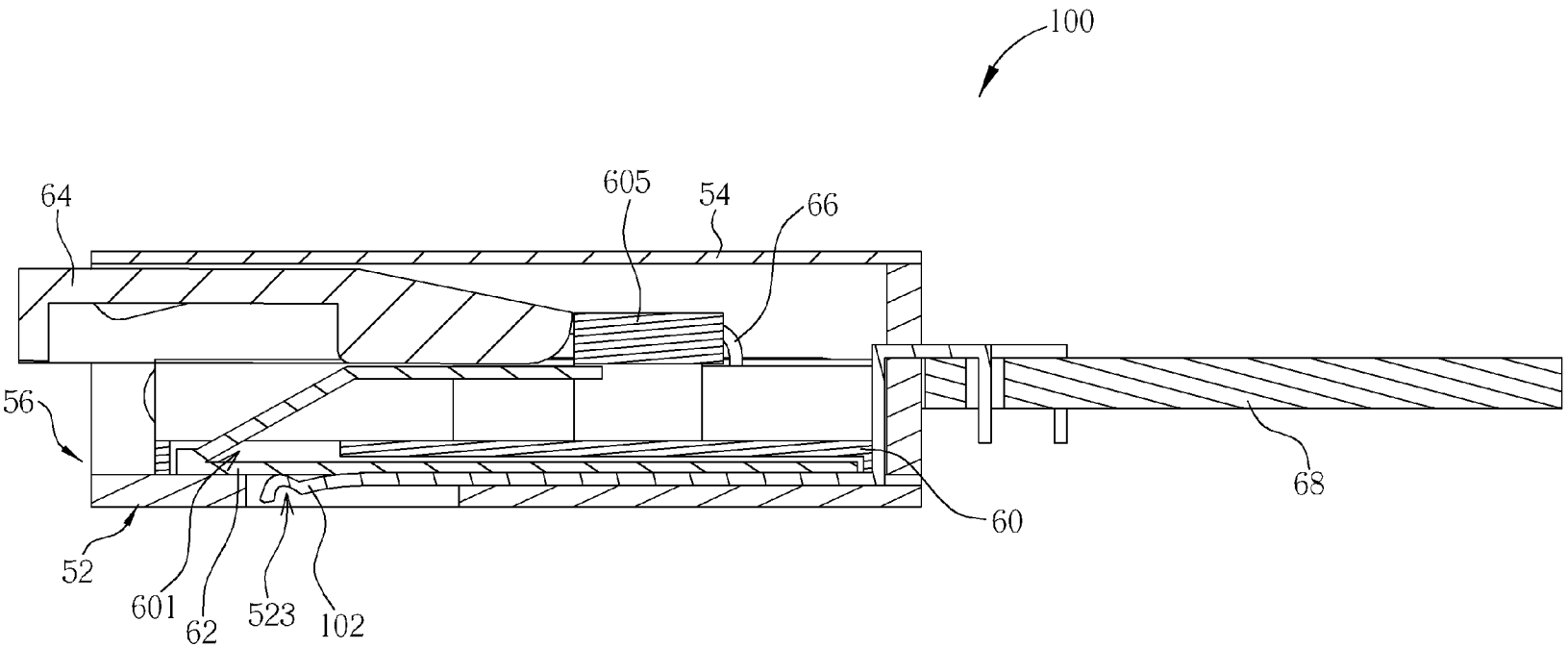
FIG. 7 and FIG. 8 are sectional views of the connector mechanism in different statuses respectively according to another preferred embodiment of the present invention.
Figure 8:
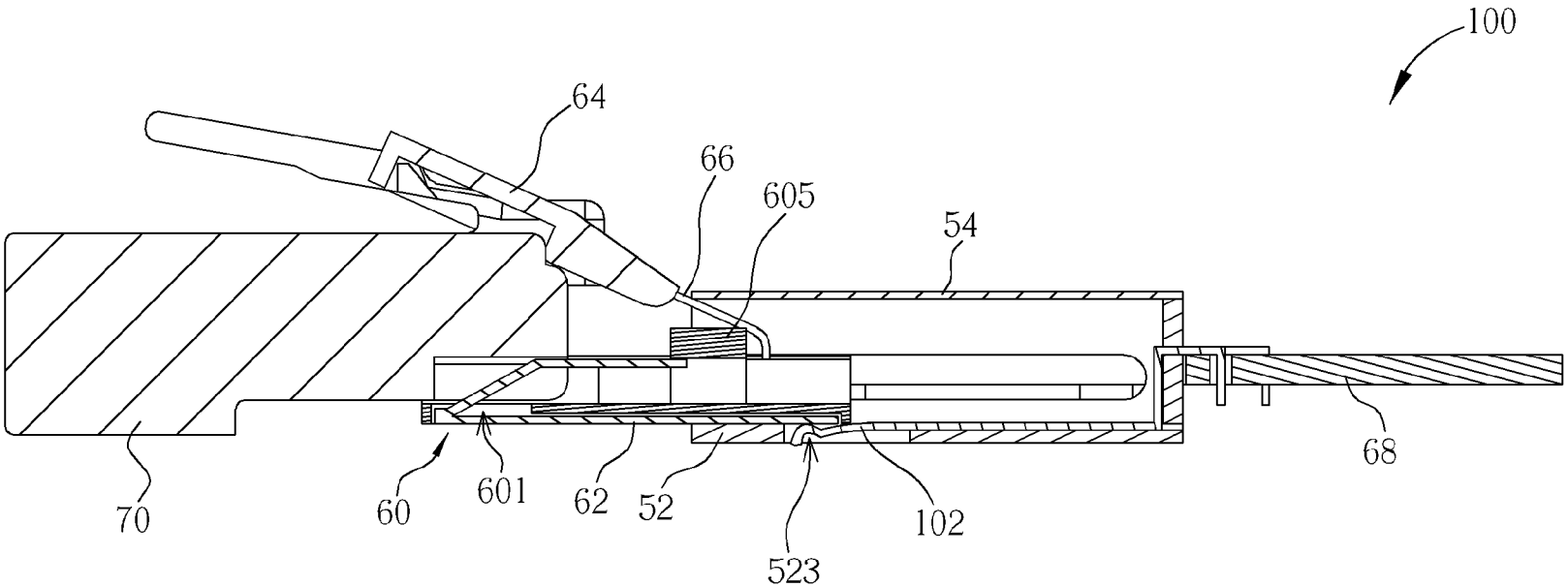

Furthermore, the connector mechanism of the present invention can be applied to other types of connector mechanism, e.g. the connector mechanism can be a normal-type connector mechanism. Please refer to FIG. 6 to FIG. 8. FIG. 6 is an exploded diagram of a connector mechanism 100 according to another preferred embodiment of the present invention. FIG. 7 and FIG. 8 are sectional views of the connector mechanism 100 in different statuses respectively according to another preferred embodiment of the present invention. Components with the same reference numerals are substantially the same through the various embodiments, and thus further descriptions will be omitted herein for simplicity. Structures and functions of the connector mechanism 100 are similar to those of the connector mechanism 50 in the above-mentioned embodiment. The main difference is that a circuit terminal 102 of the connector mechanism 100 is a normal-type circuit terminal, that is, the connector mechanism 100 is a normal-type connector mechanism. As shown in FIG. 7, since the sliding socket 60 and the sliding cover 64 are contained in the internal accommodating space of the base 52 and the casing 54, the connector mechanism 100 is in an initial status and is not connected to an external terminal. As shown in FIG. 8, since the sliding socket 60 and the sliding cover 64 are pulled out of the base 52 and the casing 54 and the resilient components 66 drive the sliding cover 64 to rotate upwards so as to increase the distance between the sliding cover 64 and the sliding socket 60, the connector mechanism 100 is capable of being connected to the external terminal. The working principle is the same as the above-mentioned embodiment, hence it is not reiterated.

In contrast to the prior art, the connector mechanism of the present invention provides a mechanism capable of adjusting the distance between the sliding cover and the sliding socket. When the connector mechanism is not in use, the sliding socket and the sliding cover are contained in the base and the casing. When the connector mechanism is in use, the sliding socket and the sliding cover are pulled out of the base and the casing. At this time, the resilient components drive the sliding cover to rotate upward so as to increase the distance between the sliding cover and the sliding socket. Accordingly, it is allowed the connector mechanism to be connected to the external terminal with larger size. Therefore, the connector mechanism of the present invention needs neither increasing the thickness of the mechanism nor adopting the design of structures partially exposed out of its appearance, and accordingly it will not affect an aesthetic feeling of appearance. Therefore, the connector mechanism of the present invention can satisfy not only specifications of recent products but also thinning design without sacrificing the aesthetic feeling of appearance.

Those skilled in the art will readily observe that numerous modifications and alterations of the device and method may be made while retaining the teachings of the invention.

What is claimed is:

1. A connector mechanism comprising:

a base;

a casing for covering the base, an opening being formed on a side of the base and the casing;

a circuit terminal installed in the base;

a sliding socket connected to the base in a slidable manner along the base and disposed on a side of the circuit terminal, at least one hole being formed on the sliding socket;

a contacting terminal installed on the sliding socket, the contacting terminal passing through the hole for contacting with the circuit terminal;

a sliding cover pivoted to the sliding socket; and at least one U-shaped resilient component, one end of the resilient component being connected to the sliding socket, the other end of the resilient component being connected to the sliding cover, and the resilient component driving the sliding cover to separate from the sliding socket when the sliding socket slides outwardly from the casing relative to the base where the casing does not constrain the sliding cover so as to generate a distance between the sliding cover and the sliding socket greater than a height of the opening.

2. The connector mechanism of claim 1, wherein sliding slots are respectively formed on a side of the base and on a side of the casing, a protruding component is formed on a side of the sliding socket, and the sliding socket is installed in the sliding slots in a slidable manner.

3. The connector mechanism of claim 1, wherein at least one slot is formed on a bottom side of the base, and the slot contains an end of the circuit terminal when the contacting terminal presses down the end of the circuit terminal.

4. The connector mechanism of claim 3, wherein the end of the circuit terminal is a bending structure and abuts against the contacting terminal.

5. The connector mechanism of claim 1, wherein the sliding socket comprises a fixing part for fixing the contacting terminal.

6. The connector mechanism of claim 1, wherein the resilient component is a clip.

7. The connector mechanism of claim 1, wherein the resilient component drives the sliding cover and the sliding socket to form an angle of approximately 24 degrees therebetween when the sliding socket slides to the position relative to the base where the casing does not constrain the sliding cover.

8. The connector mechanism of claim 1, wherein the circuit terminal is a normal-type circuit terminal.

9. The connector mechanism of claim 1, wherein the circuit terminal is a reverse-type circuit terminal.

10. The connector mechanism of claim 1, wherein the contacting terminal is an Ethernet contacting terminal.

* * * * *